US006988508B2

(12) United States Patent
Bauer et al.

(10) Patent No.: US 6,988,508 B2
(45) Date of Patent: Jan. 24, 2006

(54) DEVICE AND METHOD FOR THE PNEUMATIC CONTROL, AND REGULATION OF HYDRAULIC FLUID FLOWS

(75) Inventors: Bertram Bauer, Gaggenau (DE); Daniel Konrad, Karlsruhe (DE); Jens Schrader, Buehlertal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,495

(22) PCT Filed: May 6, 2002

(86) PCT No.: PCT/DE02/01682

§ 371 (c)(1),
(2), (4) Date: Jun. 16, 2003

(87) PCT Pub. No.: WO02/095241

PCT Pub. Date: Nov. 28, 2002

(65) Prior Publication Data

US 2004/0020531 A1 Feb. 5, 2004

(30) Foreign Application Priority Data

May 18, 2001 (DE) ..... 101 24 334

(51) Int. Cl.
*F15B 11/15* (2006.01)

(52) U.S. Cl. ..... 137/106; 297/284.6; 417/393

(58) Field of Classification Search ..... 137/106, 137/1; 417/393; 297/284.6
See application file for complete search history.

(56) References Cited

U.S. PATENT DOCUMENTS

| | | | | |
|---|---|---|---|---|
| 2,864,342 A | * | 12/1958 | Ziegelmeyer | 91/318 |
| 3,167,083 A | | 1/1965 | Nickell | |
| 3,949,646 A | | 4/1976 | Taylor | |
| 4,172,698 A | | 10/1979 | Hinz | |
| 4,655,505 A | * | 4/1987 | Kashiwamura et al. | 297/284.6 |
| 5,529,377 A | * | 6/1996 | Miller | 297/284.6 |
| 5,771,514 A | * | 6/1998 | Wilhoit | 5/644 |

FOREIGN PATENT DOCUMENTS

| | | |
|---|---|---|
| DE | 19 36 506 A | 2/1971 |
| EP | 0 812 743 B1 | 12/2000 |
| GB | 984 624 A | 3/1965 |

* cited by examiner

*Primary Examiner*—Stephen M. Hepperle
(74) *Attorney, Agent, or Firm*—Michael J. Striker

(57) ABSTRACT

The invention relates to a pneumatic open- and closed-loop control apparatus (10) for flows of pressure fluid, having one inlet conduit (14), two outlet conduits (16, 18), and one venting conduit (20), and also having a valve piston (90) mediating between these conduits and mounted in a valve chamber (92), and to a method for open- and closed-loop control of flows of pressure fluid.

Figure 1:
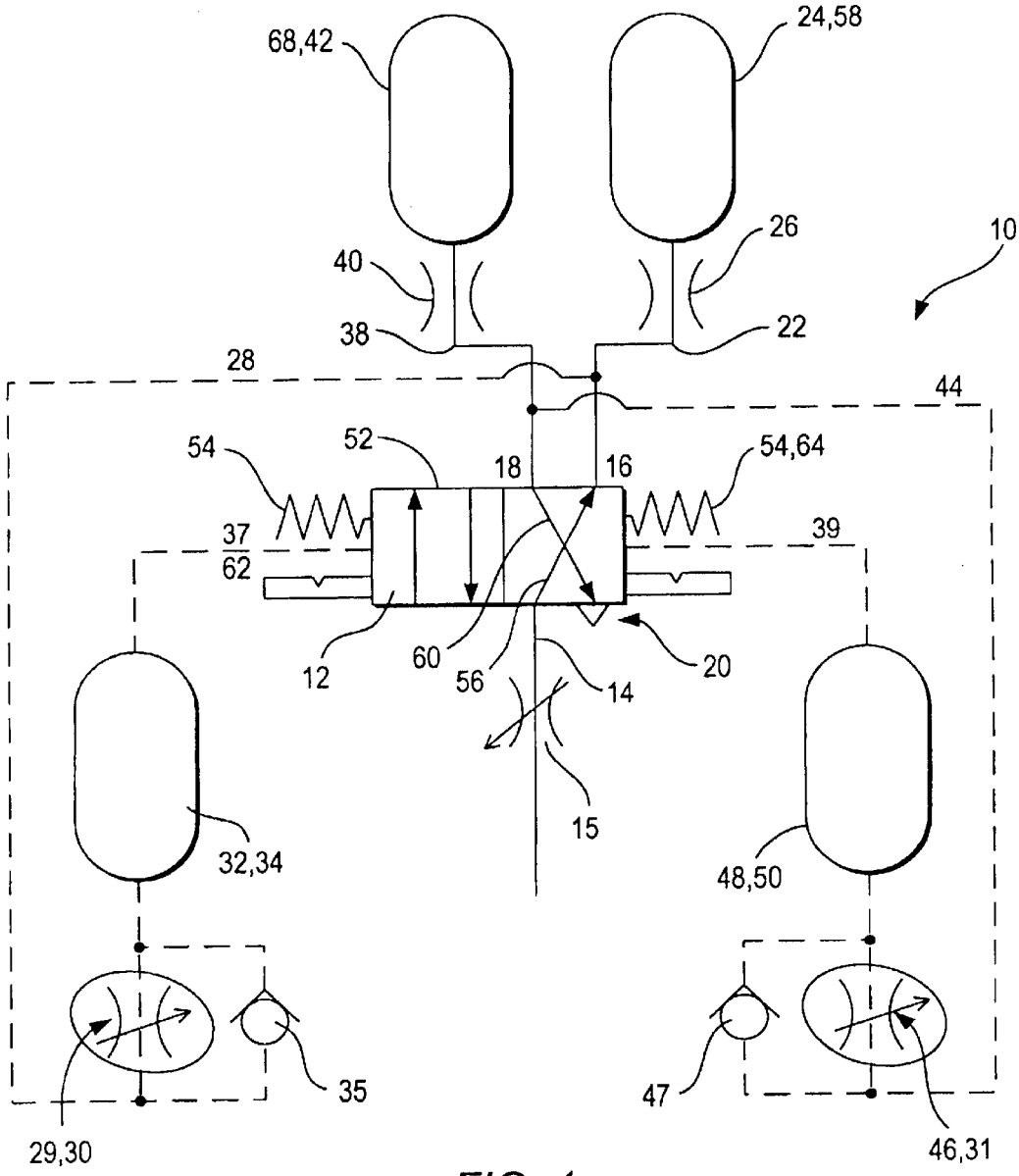

It is proposed that by means of a pneumatically driven valve piston (92), with a predeterminable time constant, one outlet conduit (16, 18) each of the pneumatic open- and closed-loop control apparatus (10) is connected to the single inlet conduit (14), while the other outlet conduit is simultaneously connected to the venting conduit (20).

16 Claims, 4 Drawing Sheets

DEVICE AND METHOD FOR THE PNEUMATIC CONTROL, AND REGULATION OF HYDRAULIC FLUID FLOWS

PRIOR ART

The invention is based on an apparatus for open- and closed-loop control of flows of pressure fluid, and on a method for open- and closed-loop control of flows of pressure fluid.

Pneumatic open- and closed-loop control circuits are used in many technical applications. As an example, European Patent Reference EP 0 812 743 B1 can be noted, which describes a pressure fluid-operated windshield wiper motor.

The windshield wiper motor of EP 0 812 743 B1 has a bidirectional work cylinder, in which two piston faces are subjected to pressure fluid counter to one another. A reversing slide, depending on the position of the drive mechanism, feeds the pressure fluid in the region of the outer end positions of the piston faces and switches it through for venting purposes in the vicinity of the inner end positions of the piston faces. The two pistons or piston faces are coupled via a mechanical connection and provided with a rack. The rack in turn engages a driven rotary member, so that the linear motion between the two outer end positions of the piston faces are converted via the driven rotary member into a rotary motion for wiper actuation.

For reversal, that is, to reverse the rotary motion as soon as one of the end positions is reached, a so-called reversing slide is used. This is a valve in which the valve slide, analogously to the bidirectional work cylinder, is also actuated bidirectionally. The reversing slide executes motions that are opposite the motion of the bidirectional work cylinder.

From U.S. Pat. No. 4,655,505, a pneumatically controlled seat for a vehicle is known that makes it possible to vary the pressure distribution of the seat for the driver. This apparatus includes many flexible air chambers, integrated with the vehicle seat, which communicate with an air pump and a pressure sensor by way of a corresponding number of connecting means. Each connecting means has one valve, which can be triggered via electronic control means that evaluate the signal of the pressure sensor.

The combined pneumatic and electrical circuit of this apparatus, because of the many valves, makes it possible to build up defined pressures in the individual air chambers of the seat and thus not only to make the seat more comfortable but also take longitudinal or lateral accelerations of the vehicle into account.

In particular, the apparatus of U.S. Pat. No. 4,655,505 makes it possible to vary the pressure in each individual air chamber continuously over time, so that an optimized pressure distribution can be established, and from an oscillating change in pressure conditions in the air chambers, the driver experiences a massage effect.

To achieve this variation in pressure conditions in the individual air chambers of the seat in U.S. Pat. No. 4,655,505, a complicated electronic monitoring and control unit with corresponding electronics and at least one pressure sensor and a central arithmetic unit are all needed.

ADVANTAGES OF THE INVENTION

The apparatus of the invention has the advantage over the prior art that electrical or electronic components can be dispensed with virtually entirely.

The pneumatic circuit according to the invention for regulating the flows of pressure fluid requires no electrically triggered valves, no pressure sensors, and no computer-controlled monitoring device. Only a compressor or the pump for furnishing the pressure fluid may optionally be embodied as an electrically driven pump.

Because of the purely pneumatically driven valve piston of the open- and closed-loop control apparatus of the invention, a slide element is moved in such a way that in alternation, one outlet conduit of the pneumatic apparatus is connected to the single inlet conduit, while the other outlet conduit is simultaneously connected to the venting conduit of the apparatus.

In this way, it is possible for a first chamber to be filled with the pressure fluid and simultaneously for a second chamber to be evacuated in alternation, without having to control the delivery of pressure fluid to the chambers via electromagnetic valves.

Advantageous provisions of the apparatus of the invention will become apparent from the characteristics recited in the dependent claims.

Because of the embodiment of connecting conduits in the movable slide element, it is possible in a simple and elegant way to establish the respective communication between the single inlet conduit, the respective first and second outlet conduit, and the venting conduit. The slide element thus acts like an adjustable shunt, which takes on the task of the respective association with one another of the total of four conduits in the apparatus.

With an adjustable throttle, which regulates the flow of pressure fluid into a work chamber disposed parallel to the respective outlet conduit, it is possible in a simple way to achieve a delay element for the circuit of the invention, for instance, so that the time constant of the alternating motion can be adjusted flexibly. Not until a previously defined pressure prevails in the work chamber is a sufficiently strong back driving force exerted on the valve piston and the slide element connected to it. The slide element is then moved automatically, so that the alternative association among the conduits is established. Thus it is possible solely by way of the size of the work chambers and the adjustment of the throttles to achieve the time lag within the pneumatic circuit without electronic components.

Advantageously, the work chambers of the apparatus of the invention that are associated with the two outlet conduits are part of the valve chamber in which the valve piston moves. The work chambers are closed off from the valve chamber, for instance via a diaphragm, each diaphragm being connected to the valve piston in the vicinity of one of its ends. These elastic diaphragms, which can advantageously comprise an elastomer, such as rubber or silicone, transmit the pressure prevailing in the work chamber to the valve piston in a simple way. Thus by the relative pressure difference between the work chambers, the valve piston can be set into an oscillating motion, which correspondingly drives the slide element that controls the pressure fluid.

In order for the open- and closed-loop control apparatus claimed to be capable of building up a desired pressure, the valve piston is not disposed freely movably in the valve chamber but instead is secured by a locking device. This locking device counteracts the force on the valve piston that is generated by the pressure difference in the work chambers. The locking device, which can be in the form of a detent spring, for instance, thus also makes it possible to adjust the internal time constant of the pneumatic open- and closed-loop control apparatus of the invention in a desired way.

In an advantageous version of the apparatus of the invention, the force that the locking device exerts on the valve piston can be adjusted manually, or optionally automatically, so that the time constant of the oscillating motion of the valve piston can be changed in a simple way, for instance by the driver himself.

An economical and lightweight embodiment of the apparatus of the invention is obtained if it is made entirely or in part of plastic. However, other materials are also possible for the open- and closed-loop control apparatus claimed, without sacrifices in its mode of operation.

One advantageous application of the open- and closed-loop control apparatus of the invention is achieved if a small compressor for the pressure fluid, such as a vane-cell compressor or a membrane pump, is connected to one inlet conduit, and the two outlet conduits each communicate with a flexible air chamber. In this version, the open- and closed-loop control apparatus of the invention assures that in alternation, one of the air chambers at a time is pumped up, while the other is at the same time vented, causing an alternating motion of the air chambers, in the event that the apparatus of the invention is subjected only to a constant flow of pressure fluid.

The time constant of this alternating motion is determined solely by the passive means in the apparatus of the invention and can be varied and adapted to given requirements in a simple and advantageous way by means of various throttles and locking elements.

If the apparatus of the invention, including a pump that pumps the pressure fluid and the air chambers on the outlet side, is built into the seat of a vehicle, then as a result an advantageous massage effect, for instance, for the vehicle passengers can be achieved without having to use a complicated electronic circuit of the kind that is usual in the apparatuses of the prior art. The claimed invention achieves this massage system with a purely pneumatic open- and closed-loop control circuit.

It is thus possible to achieve a corresponding vehicle seat with great comfort, using only passive, pneumatic means. The use of electronic switching and closed-loop control devices can advantageously be dispensed with. This markedly lessens the effort and expense for achieving such massage systems.

The method of the invention makes it possible in a simple and advantageous way to control flows of pressure fluid in open- and closed-loop fashion solely by pneumatic means. In particular, the claimed method makes it possible in a simple way to realize adjustable time constants and suitably-adapted delays for the alternating motions, solely by means of pneumatically regulating the flows of pressure fluid.

DRAWING

In the drawing, several exemplary embodiments of the apparatus of the invention are shown, which are to be explained in further detail in the ensuing description.

Figure 2:
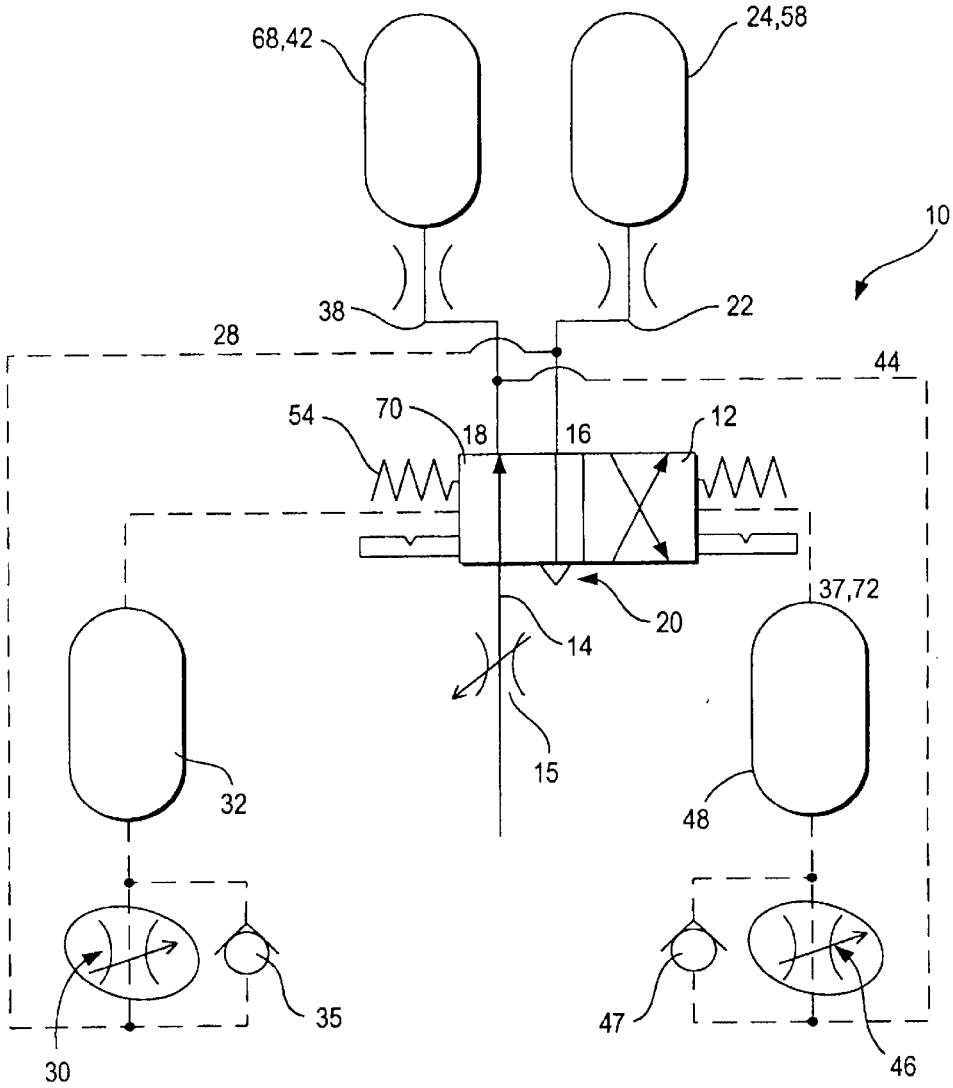
Figure 3:
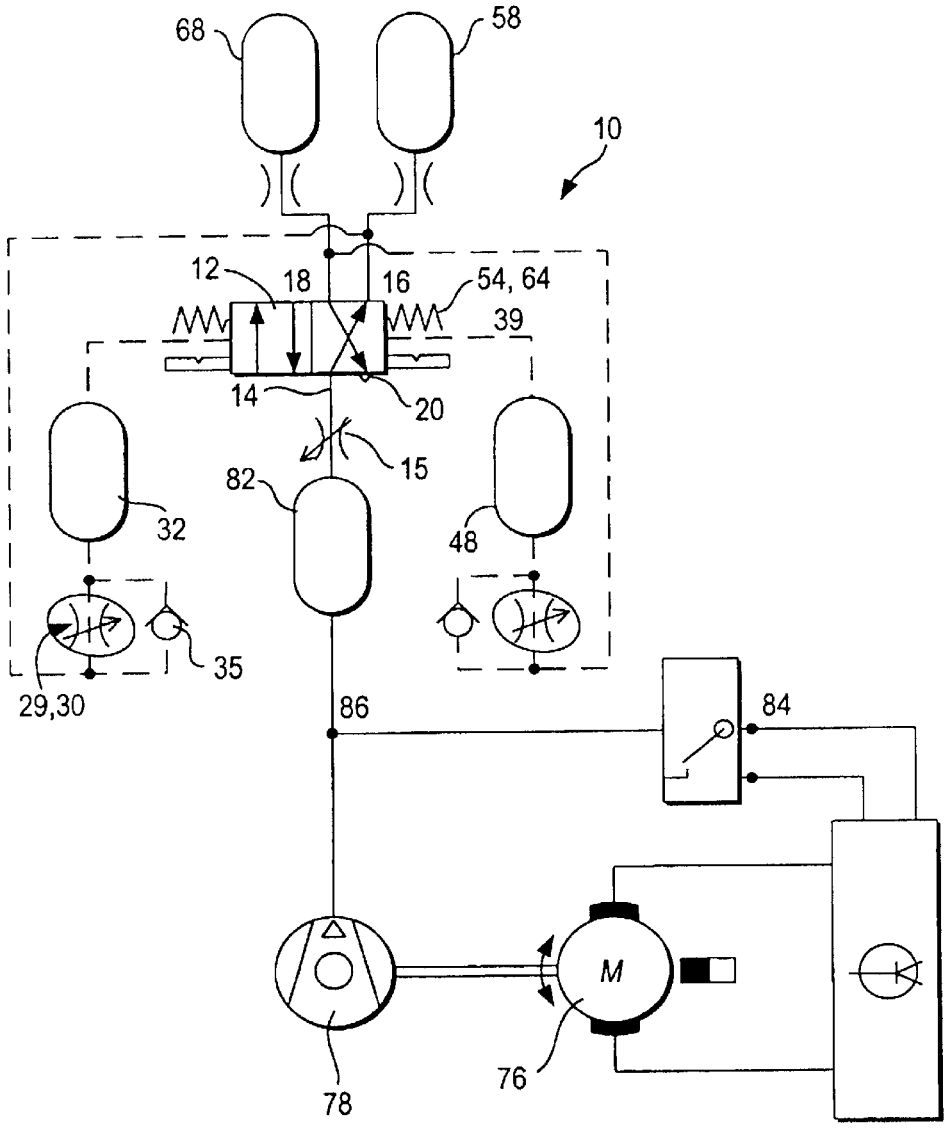
Figure 4:
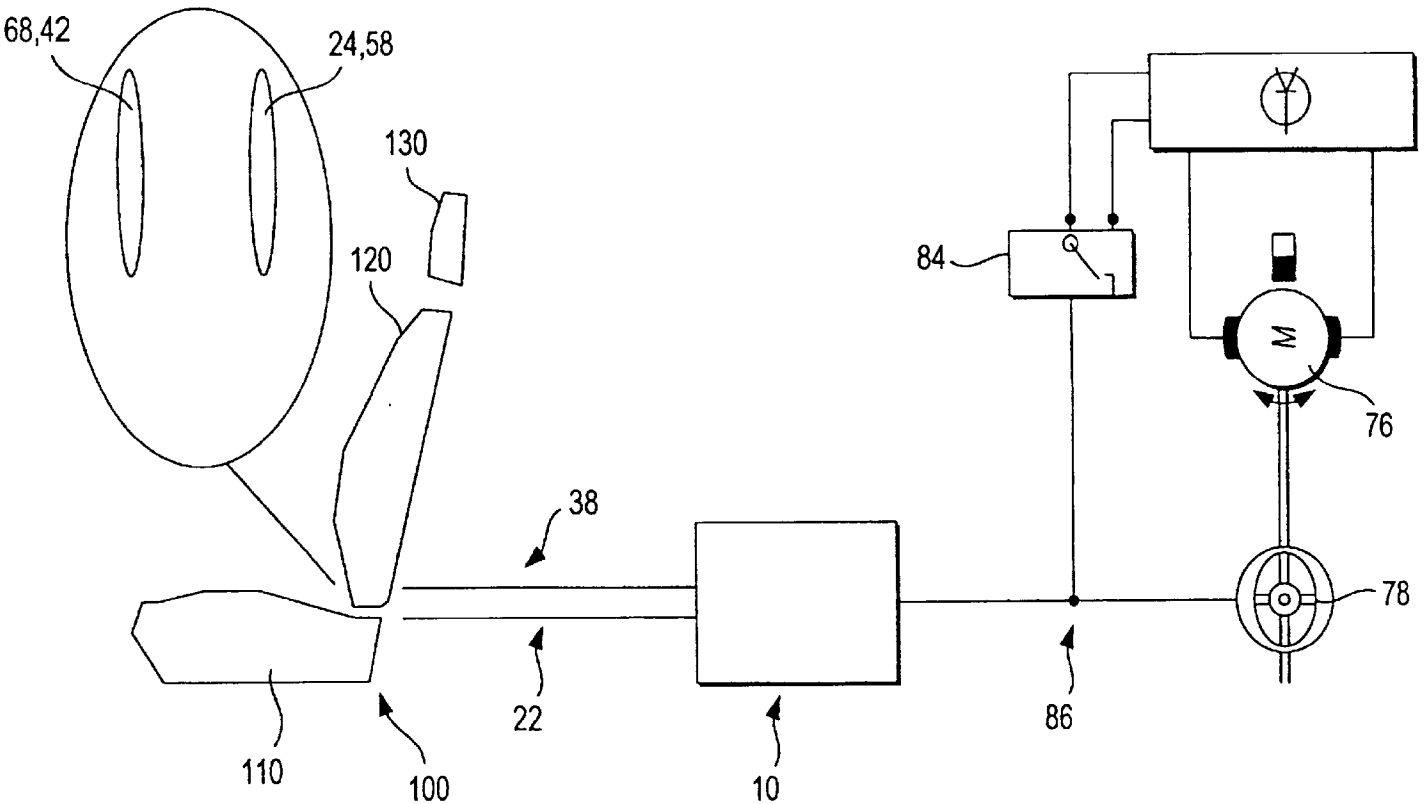

Shown are:

FIG. 1, a schematic illustration of a first exemplary embodiment of a circuit of the pneumatic apparatus of the invention, for a first end position of the slide elements of the apparatus;

FIG. 2, a schematic illustration of the first exemplary embodiment of a circuit of the pneumatic apparatus of the invention, for a second end position of the slide elements of the apparatus;

FIG. 3, a schematic illustration of a second exemplary embodiment of a circuit of the pneumatic apparatus of the invention, for a first end position of the slide elements of the apparatus;

FIG. 4, a section through part of an exemplary embodiment of the apparatus of the invention, in a first end position of the slide element; and FIG. 5, a plan view on one exemplary embodiment of a conduit plate and a slide element, disposed beneath it, of the apparatus of the invention.

DESCRIPTION OF THE EXEMPLARY EMBODIMENTS

The schematic circuit of the pneumatic apparatus 10 of the invention, shown in FIG. 1, shows a slide element 12, which connects an inlet conduit 14 of the apparatus with a first outlet conduit 16 and connects a second outlet conduit 18 with a venting conduit 20. The venting conduit 20 need not necessarily be connected to atmospheric pressure. On the contrary, a closed circulatory system for the apparatus is also conceivable.

An adjustable throttle 15 precedes the inlet conduit 14. The outlet conduit 16 communicates with a container 24 via connecting means 22. The connecting means 22 has among other elements a throttle 26, with which the flow through the connecting means 22 can be adjusted in a desired way. Branching off from the outlet conduit 16 is a further connecting means 28, which via a delay element 29, which in the present exemplary embodiment is embodied by a throttle 30, leads to a reservoir 34, which acts as a first work chamber 32 and can be emptied via a check valve 35 and the connecting means 28. The reservoir 32 is in turn coupled in terms of pressure to the slide element 12 via a device 37.

The second outlet conduit 18 on the one hand communicates with a second container 42 via connecting means 38 and a throttle 40, and on the other is coupled to a reservoir 50, acting as a second work chamber 48, via connecting means 44 and a throttle 46. The lead line to the reservoir 50 also has a delay element 31 and a check valve 37 for venting purposes. Like the reservoir 34, however, the reservoir 50 is coupled on the opposite side to the slide element 12 via a device 39.

In its interior, the slide element 12 has continuous conduits 52, which each provide the respective communications between the one inlet conduit 14 and the two outlet conduits 16 and 18 and the venting conduit 20, as a function of the position of the slide element 12. The mobility of the slide element 12 is regulated by a locking device 54, which is shown schematically in FIG. 1 in the form of an elastic spring 64.

The mode of operation of the pneumatic open- and closed-loop control apparatus 10 of the invention will now be described in further detail in terms of the illustrations in FIGS. 1 and 2.

If the inlet conduit 14 of the apparatus 10 of the invention, as shown in FIG. 1, is subjected to a pressure fluid, such as air, then the pressure fluid passes through a conduit 56 and the throttle 26 to enter the container 24, which is embodied for instance as an elastic air cushion 58. The air cushion 58 will fill with the pressure fluid and accordingly be inflated. At this moment, the container 42 communicates with the venting conduit 20 via a conduit 60, so that atmospheric pressure, for instance, prevails in it.

While the air cushion 58 is being inflated, some of the flow of pressure fluid is delivered to the work chamber 32, via the connecting means 28 and a suitably adjusted throttle 30. The precise adjustment of the throttle 30 determines the time required to fill the work chamber 32. The work chamber 32 communicates with the 12, for instance via an elastic diaphragm 62. When the pressure in the work chamber 32 rises, and the diaphragm 62 expands, the force on the slide element 12 is increased. The slide element 12 is locked via the locking device 54, which is indicated in FIG. 1 in the form of two elastic springs 64. If the force exerted on the slide element 12 by the pressure in the work chamber 32 exceeds the detent force of the slide element 12, then the slide element is displaced and assumes a position as shown in FIG. 2.

In this position in FIG. 2, the container 24 now communicates with the venting conduit 20 via a conduit 66 in the slide element 12, so that the pressure built up in the container 24 can escape, and the air cushion 58 thus empties again. At the same time, the associated work chamber 32 also empties via the valve 35, the connecting means 28, and the conduit 66 in the slide element 12.

In the position of the slide element 12 shown in FIG. 2, the container 42, which may be a flexible air cushion 68, now communicates with the single inlet conduit 14 via a conduit 70 and is filled by the pressure fluid present there. At the same time, some of this pressure fluid is delivered to the second work chamber 48 via the connecting means 44 and the throttle 46.

The pressure in the second work chamber now rises in accordance with the adjustment of the throttle 46, while the container 42 is pumped up, as has already been described analogously above for the first work chamber. Via the device 37, which by way of example may also be a diaphragm 72, a force is thus exerted on the slide element 12. If this force is great enough to overcome the detent force of the slide element 12 resulting from the locking device 54, or in other words if a high enough pressure has built up in the work chamber 48, then the slide element 12 is thrust back again into its first position—shown in FIG. 1—so that the associated air cushion 68 is again vented via the conduit 60 of the slide element 12.

Thus one complete cycle of the open- and closed-loop control apparatus of the invention is now concluded, and the system on its own begins again to fill the container 58, in the way already described above.

Because of the alternating inflation and venting of the air cushions involved, it is possible, with a system based on this invention located in the seat of a vehicle, to improve the seating comfort and to provide relief for the spinal column through the resultant massage effect. The oscillation period of this motion can be adjusted by way of adjusting the relative throttle sizes, the size of the volumes involved, and not least also via the flow of pressure fluid pumped. By directly adjusting the strength of the locking device, the user himself can for instance easily adapt the frequency of the motion individually.

For the pneumatic supply to the apparatus, a small compressor, such as a vane-cell compressor, or a diaphragm pump, can be used. Such a device is shown in FIG. 3. The pump 78, driven by a motor 76 that is preferably employed in the form of an electric motor, subjects the apparatus 10 of the invention, via the adjustable throttle 15 and the inlet conduit 14, to the pressure fluid, which is preferably air but can certainly be some other mixture or gas.

To shorten the running time of the pump and thus lengthen its service life, this pump can, as shown in the exemplary embodiment of the apparatus of the invention in FIG. 3, monitor a volume 82 that precedes the inlet conduit 14. To that end, the motor 76 that drives the pump 78 is controlled via a pressure sensor 84 in the lead line 86 and an associated switch.

The pump 78 and the associated motor 76 driving it can be disposed in the immediate vicinity of the pneumatic apparatus 10, or it can be spatially separated from it via appropriate connecting means and thus optionally decoupled acoustically from the vehicle seat.

FIG. 4 shows a cross section through one exemplary embodiment of the pneumatic apparatus of the invention.

The pressure fluid passes through the inlet conduit 14 and a conduit plate 88 to reach the slide element 12. The slide element 12 is solidly connected to a valve piston 90. The valve piston 90 is in turn disposed in a valve chamber 92. The slide element 12 can be displaced relative to the conduit plate 88 under it, that is, on the side of the conduit plate remote from the inlet conduit or the outlet conduits, so that selectively, various openings in the conduit plate 88 come into coincidence with the conduits 52 of the slide element 12.

This is shown in FIG. 5 in a plan view on the conduit plate 88. The movable slide element 12 is shown under the conduit plate 88. The pressure applied to the inlet conduit 14 communicates permanently with the valve chamber 92. The work chamber 48 is in constant communication with the outlet conduit 18, and the work chamber 33 is in constant communication with the outlet conduit 16.

In the position of the slide element 12 shown in FIG. 5, the connecting conduit from the valve chamber 92 to the outlet conduit 18 would be uncovered, and the outlet conduit 16 would communicate with the venting conduit 20 of the apparatus via a conduit in the slide element 12.

By means of such a position of the slide element 12, the pressure in the work chamber 32 is vented and is increased in the work chamber 48. This takes place as long as the pressure difference between the two work chambers 48 and 32 is great enough to overcome the adjustable detent force of the locking device 54, which in the exemplary embodiment of FIG. 4 is embodied by a prestressed detent spring in the form of a snap ball 94. However, the locking device 54 can equally well be embodied by a leaf spring or other locking devices familiar to one skilled in the art. The contact pressure of the locking device can be varied via an adjusting mechanism 96.

The differential pressure of the work chambers 48 and 32 brings about a resultant force on the flexible diaphragms 62 and 72, so that the valve piston 90 connected to the diaphragms is moved counter to the force of the detent spring 94, and the slide element 12 is displaced into the second end position of the apparatus 10.

In this position, the outlet conduit 16 is now uncovered by the slide element 12 and made to communicate with the valve chamber 92. The outlet conduit 18 is made to communicate with the venting conduit 20 via a corresponding conduit in the slide element 12. This position of the valve piston 90 is maintained until the differential pressure of the two work chambers 32 and 48 again overcomes the detent force of the locking device 54, and the valve piston 90 and thus also the slide element 12 have been switched back again.

The apparatus of the invention is not limited to use for alternating inflation and venting of air cushions in vehicle seats.

In principle, all intermittent or oscillating motions of pistons and other adjusting elements are conceivable as additional areas of use of the pneumatic open- and closed-loop control apparatus of the invention.

What is claimed is:

1. A pneumatic open- and closed-loop control apparatus (10), comprising:

an inlet conduit (14) subjected to a pressure fluid;

first and second outlet conduits (16, 18); and a venting conduit (30) and a movable valve piston (90), mounted in a valve chamber (92) and mediating between the conduits, wherein by means of a slide element (12), connected to the pneumatically driven valve piston (90), the first outlet conduit (16, 18) of the pneumatic open- and closed-loop control apparatus (10) is connected in alternation with one inlet conduit (14), and at the same time the second outlet conduit (18,16) is connected to the venting conduit (20) of the apparatus (10), wherein the one inlet conduit communicates with a small compressor (78) and the outlet conduits (32, 48) each communicate with a respective container (24, 42), and wherein the compressor (78) on a side toward the inlet conduit is switchable by means of a pressure sensor (84) mounted in a connecting means (86).

2. The pneumatic open- and closed-loop control apparatus (10) of claim 1, wherein communication of the first outlet conduit (16, 18) with the inlet conduit (14) and of the second outlet conduit (16, 18) with the venting conduit (20) is realized by means of conduits (52) in the slide element (12).

3. The pneumatic open- and closed-loop control apparatus (10) of claim 1, wherein the one inlet conduit (14) communicating with the first outlet conduit (16, 18) simultaneously also communicates, via a pneumatic delay element (29, 31), with a respective work chamber (32, 48), associated with the respective outlet conduit.

4. The pneumatic open- and closed-loop control apparatus (10) of claim 3, wherein the delay element (29, 31), for generating a predetermined time constant, contains a throttle (30, 46).

5. The pneumatic open- and closed-loop control apparatus (10) of claim 4, wherein the work chambers (32, 19) associated with the respective outlet conduits (16, 18) are part of the valve chamber (92).

6. The pneumatic open- and closed-loop control apparatus (10) of claim 3, wherein the work chambers (32, 48) are each demarcated from the remaining valve chamber (92) via respective diaphragms (62, 72) communicating with the valve piston (90).

7. The pneumatic open- and closed-loop control apparatus (10) of claim 6, wherein the diaphragms (72) of the work chambers (32, 48) comprise an elastomer in the form of silicone or rubber.

8. The pneumatic open- and closed-loop control apparatus (10) of claim 7, wherein the valve piston (90) is movable within the valve chamber (92) by means of a pressure difference in the two work chamber (32, 48) via the diaphragms (72).

9. The pneumatic open- and closed-loop control apparatus (10) of claim 8, wherein the mobility of the valve piston (90) in the valve chamber (92) is adjustable via a locking device (54).

10. The pneumatic open- and closed-loop apparatus (10) of claim 1, wherein the locking device (54) has an elastic spring element (94).

11. The pneumatic open- and closed-loop control apparatus (10) of claim 1, wherein the apparatus (10) is embodied at least in part of plastic.

12. A vehicle seat for a motor vehicle, wherein at least one of the open- and closed-loop control apparatuses (10) of claim 1 are integrated into the seat, in order to enhance seating comfort and/or generate a massage effect.

13. The pneumatic open- and closed-loop control apparatus (10) of claim 4, wherein the throttle (30, 46) is an adjustable throttle of variable diameter.

14. The pneumatic open- and closed-loop control apparatus (10) of claim 1, wherein the small compressor (78) is a vane-cell compressor or a diaphragm pump.

15. A pneumatic open- and closed-loop control apparatus (10), comprising:

an inlet conduit (14) subjected to a pressure fluid;

first and second outlet conduits (16, 18); and a venting conduit (30) and a movable valve piston (90), mounted in a valve chamber (92) and mediating between the conduits, wherein by means of a slide element (12), connected to the pneumatically driven valve piston (90), the first outlet conduit (16, 18) of the pneumatic open- and closed-loop control apparatus (10) is connected in alternation with one inlet conduit (14), and at the same time the second outlet conduit (18, 16) is connected to the venting conduit (20) of the apparatus (10), wherein the one inlet conduit communicate with a small compressor (78) and the outlet conduits (32, 48) each communicate with a respective container (24, 42), and wherein the containers (24, 42) associated with the outlet conduits are embodied as elastic air cushions (58, 68).

16. The pneumatic open- and closed-loop control apparatus (10) of claim 15, wherein the elastic air cushions (58, 68) are integrated into upholstery of a vehicle seat.

* * * * *